US011248187B2

(12) United States Patent
Iino et al.

(10) Patent No.: US 11,248,187 B2
(45) **Date of Patent: *Feb. 15, 2022**

(54) LUBRICANT ADDITIVE COMPOSITION, LUBRICATING COMPOSITION CONTAINING SAME AND ENGINE OIL COMPOSITION CONSISTING OF LUBRICATING COMPOSITION

(71) Applicant: ADEKA CORPORATION, Tokyo (JP)

(72) Inventors: Shinji Iino, Tokyo (JP); Eiji Katsuno, Tokyo (JP); Taro Sumi, Tokyo (JP)

(73) Assignee: ADEKA CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/211,076

(22) Filed: Mar. 24, 2021

(65) Prior Publication Data

US 2021/0253973 A1 Aug. 19, 2021

Related U.S. Application Data

(63) Continuation-in-part of application No. 16/310,503, filed as application No. PCT/JP2017/023621 on Jun. 27, 2017, now abandoned.

(30) Foreign Application Priority Data

Jun. 29, 2016 (JP) ..... 2016-128713

(51) Int. Cl.

| | |
|---|---|
| ***C10M 141/12*** | (2006.01) |
| ***C10M 133/06*** | (2006.01) |
| ***C10M 135/18*** | (2006.01) |
| ***C10M 139/00*** | (2006.01) |
| ***C10M 169/04*** | (2006.01) |
| *C10N 10/04* | (2006.01) |
| *C10N 10/12* | (2006.01) |
| *C10N 30/06* | (2006.01) |
| *C10N 30/10* | (2006.01) |
| *C10N 30/12* | (2006.01) |
| *C10N 40/25* | (2006.01) |

(52) U.S. Cl.

CPC ..... *C10M 141/12* (2013.01); *C10M 133/06* (2013.01); *C10M 135/18* (2013.01); *C10M 139/00* (2013.01); *C10M 169/04* (2013.01); *C10M 2207/144* (2013.01); *C10M 2215/04* (2013.01); *C10M 2215/223* (2013.01); *C10M 2219/066* (2013.01); *C10M 2227/00* (2013.01); *C10N 2010/04* (2013.01); *C10N 2010/12* (2013.01); *C10N 2030/06* (2013.01); *C10N 2030/10* (2013.01); *C10N 2030/12* (2013.01); *C10N 2040/252* (2020.05); *C10N 2040/255* (2020.05)

(58) Field of Classification Search

CPC ..... C10M 2215/223; C10M 2227/00; C10M 2219/066; C10M 2215/04; C10M 2207/144; C10N 2010/04; C10N 2010/12

See application file for complete search history.

(56) References Cited

U.S. PATENT DOCUMENTS

| | | | | |
|---|---|---|---|---|
| 8,722,597 | B2 * | 5/2014 | Tatsumi | C10M 141/12 508/423 |
| 2010/0269781 | A1 * | 10/2010 | Derevjanik | C10M 163/00 123/196 R |
| 2014/0051621 | A1 * | 2/2014 | DeSantis | C10M 163/00 508/545 |
| 2014/0342958 | A1 | 11/2014 | Kubo | |

FOREIGN PATENT DOCUMENTS

| | | |
|---|---|---|
| CN | 1317555 | 10/2001 |
| CN | 101629124 | 1/2010 |
| CN | 104024389 | 9/2014 |
| JP | 05-279686 | 10/1993 |
| JP | 07-150173 | 6/1995 |
| JP | 08-067890 | 3/1996 |
| JP | 2000-192068 | 7/2000 |
| JP | 2001-262175 | 9/2001 |
| JP | 2003-221588 | 8/2003 |
| JP | 2005-082709 | 3/2005 |
| JP | 2011-195774 | 10/2011 |
| JP | 2012-197393 | 10/2012 |
| JP | 2013-119597 | 6/2013 |

OTHER PUBLICATIONS

International Search Report dated Aug. 8, 2017 in International (PCT) Application No. PCT/JP2017/023621.

* cited by examiner

*Primary Examiner* — Vishal V Vasisth

(74) *Attorney, Agent, or Firm* — Wenderoth, Lind & Ponack, L.L.P.

(57) ABSTRACT

A lubricating composition including: a base oil, a lubricant additive composition including, as a component (A), an organic molybdenum compound of the formula (1) described in the specification, and as a component (B), an amine compound of the formula (2) described in the specification, and a specific metal-based cleaner, wherein a content of the component (B) is 2.9 to 18.6 parts by mass relative to 100 parts by mass of molybdenum atoms of the component (A), and a content of the metal-based cleaner is 0.1% to 10% by mass relative to a total amount of the lubricating composition, wherein the lubricating composition does not include tetraalkyl thiuram disulphide, and wherein the component (A) in terms of the amount of molybdenum atoms is 400 to 1200 ppm by mass relative to a total amount of the lubricating composition.

8 Claims, No Drawings

LUBRICANT ADDITIVE COMPOSITION, LUBRICATING COMPOSITION CONTAINING SAME AND ENGINE OIL COMPOSITION CONSISTING OF LUBRICATING COMPOSITION

This application is a CIP of U.S. Pat. No. 16,310,503, filed Dec. 17, 2018 now abandoned, wherein 16310503 is a 371 of PCT/JP2017/023621, filed Jun. 27, 2017.

The present invention relates to a lubricant additive composition containing an organic molybdenum compound, a lubricating composition containing the lubricant additive composition and an engine oil consisting of the lubricating composition.

BACKGROUND ART

Reductions in automobile fuel consumption initiated due to the oil crisis is a very important issue in view of resource protection and environmental protection. Automotive fuel consumption has been improved by reduction of the body weight of automobiles, improvements in engine combustion and reduction of friction in engines and power trains. Engine friction has been reduced by, for example, improvement in valve system mechanisms, reduction of surface roughness of sliding members and use of fuel-efficient engine oil. In order to reduce fuel consumption by engine oil, reduction of viscosity aimed at reducing friction loss under fluid lubrication conditions in piston systems and bearing members has been studied, and addition of friction reducing agents aimed at reducing friction loss under mixed lubrication and boundary lubrication in valve systems have been proposed.

Organic molybdenum compounds containing sulphur such as molybdenum dialkyldithiocarbamate and molybdenum dialkyldithiophosphate have the excellent effect of friction reduction, and thus are widely used for engine lubricating oil and the like. However, the effect of friction reduction only by increasing the amount of organic molybdenum compounds added has limitations, and an increase in the amount of organic molybdenum compounds added causes problems such as generation of deposits due to precipitated or deteriorated organic molybdenum compounds. In order to improve the effect of the organic molybdenum compound, use of lubricating oil compositions containing an organic molybdenum compound and an ashless friction regulator, for example lubricating oil compositions containing an organic molybdenum compound and a polyhydric alcohol fatty acid partial ester (for example, see Patent Documents 1 to 3) or an alkyl alkanolamine or fatty acid alkanolamide (for example, see Patent Documents 4 and 5) have been studied.

It is believed that organic molybdenum compounds containing sulphur are decomposed on sliding surfaces to form films similar to molybdenum disulphide, which films reduce friction. Therefore, lubricating oil compositions (for example, see Patent Documents 6 and 7) containing an organic molybdenum compound containing sulphur and tetrabenzyl thiuram disulphide have been studied and it is thought that in order to increase solubility of tetrabenzyl thiuram disulphide, an amine compound is effective (for example, see Patent Document 7). However, in order to dissolve tetrabenzyl thiuram disulphide in a base oil, a high amount of amine compound is required and copper components of machines made of copper or copper alloys are corroded in some cases.

CITATION LIST

Patent Documents

[Patent Document 1] Japanese Patent Application Publication No. H05-279686

[Patent Document 2] Japanese Patent Application Publication No. H08-067890

[Patent Document 3] Japanese Patent Application Publication No. 2005-082709

[Patent Document 4] Japanese Patent Application Publication No. H07-150173

[Patent Document 5] Japanese Patent Application Publication No. 2003-221588

[Patent Document 6] Japanese Patent Application Publication No. 2012-197393

[Patent Document 7] Japanese Patent Application Publication No. 2013-119597

SUMMARY OF INVENTION

Technical Problem

The level of reduction in automobile fuel consumption being sought has recently increased, and there is a need for an engine oil having further reduced friction. In addition, a lubricant having an improved effect of friction reduction for other machines is also expected. Therefore, an issue to be addressed by the present invention is to further improve the effect of friction reduction by an organic molybdenum compound.

Solution to Problem

The inventors of the present invention carried out extensive studies in order to solve the above problem and, as a result, found that by adding a small amount of dialkylamine to an organic molybdenum compound containing sulphur, the effect of friction reduction by the organic molybdenum compound is increased without corrosion of copper or copper alloys. The inventors thereby completed the present invention. Namely, the present invention pertains to a lubricant additive composition containing, as a component (A), an organic molybdenum compound represented by the following general formula (1), and as a component (B), an amine compound represented by the following general formula (2), wherein content of the component (B) is 1 to 20 parts by mass relative to 100 parts by mass of molybdenum atoms derived from the component (A):

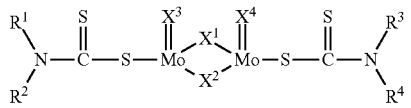

(1)

wherein $R^1$ to $R^4$ respectively represent an alkyl group having 1 to 18 carbon atoms, and $X^1$ to $X^4$ respectively represent an oxygen atom or a sulphur atom;

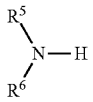

(2)

wherein $R^5$ and $R^6$ respectively represent an alkyl group having 1 to 18 carbon atoms or an alkenyl group having 2 to 18 carbon atoms.

Advantageous Effects of Invention

By adding to an organic molybdenum compound represented by general formula (1) a dialkylamine represented by general formula (2) at a specific ratio, the effect of friction reduction by the organic molybdenum compound can be improved and corrosion of components used in machines, particularly corrosion of copper and copper alloys can be significantly prevented. Therefore, the present invention can provide an advantageous lubricant additive composition for lubricating compositions.

DESCRIPTION OF EMBODIMENTS

In the lubricant additive composition of the present invention, the component (A) is an organic molybdenum compound represented by general formula (1). In the general formula (1), $R^1$ to $R^4$ respectively represent an alkyl group having 1 to 18 carbon atoms. Examples of the alkyl group having 1 to 18 carbon atoms include a methyl group, an ethyl group, a propyl group, a butyl group, a pentyl group, a hexyl group, a heptyl group, an octyl group, an isopropyl group, an isobutyl group, a secondary butyl group, a tertiary butyl group (hereinafter "tertiary" is abbreviated as "t"), an isopentyl group, a secondary pentyl group, a t-pentyl group, a secondary hexyl group, a secondary heptyl group, a secondary octyl group, a 2-ethylhexyl group, a nonyl group, an isononyl group, a decyl group, a branched decyl group, a dodecyl group, a tridecyl group, a branched tridecyl group, a tetradecyl group, a pentadecyl group, a hexadecyl group, a heptadecyl group, an octadecyl group and the like. Because of preferable solubility to mineral oil and hydrocarbon synthetic oil and preferable thermal stability, $R^1$ to $R^4$ are respectively preferably an alkyl group having 6 to 16 carbon atoms, more preferably an alkyl group having 7 to 14 carbon atoms and still more preferably an alkyl group having 8 to 13 carbon atoms. Branched alkyl groups are preferred to linear alkyl groups because the molybdenum compound may have a lower melting point and may be less deposited. $R^1$ to $R^4$ may be the same hydrocarbon group or different hydrocarbon groups; however, it is preferable that at least one of $R^1$ to $R^4$ is different from other groups because the molybdenum compound may have a lower melting point and may be less deposited, and it is more preferable that $R^1$ and $R^2$ are the same and $R^3$ and $R^4$ are the same and $R^1$ and $R^3$ are different because of industrial availability. Specifically, the compound wherein $R^1$ and $R^2$ are respectively 2-ethylhexyl and $R^3$ and $R^4$ are respectively a branched tridecyl group, or $R^1$ to $R^4$ are respectively 2-ethylhexyl is preferable and a compound wherein $R^1$ and $R^2$ are respectively 2-ethylhexyl and $R^3$ and $R^4$ are respectively a branched tridecyl group is more preferable.

In general formula (1), $X^1$ to $X^4$ respectively represent an oxygen atom or a sulphur atom. Because of excellent lubricity, it is preferable that two to three of $X^1$ to $X^4$ are sulphur atoms and the rest are oxygen atom(s). For example, a compound wherein $X^1$ and $X^2$ are respectively a sulphur atom and $X^3$ and $X^4$ are respectively an oxygen atom is preferred.

In the present invention, an organic molybdenum compound (A1) wherein $R^1$ and $R^2$ are respectively 2-ethylhexyl and $R^3$ and $R^4$ are respectively a branched tridecyl group; and $X^1$ and $X^2$ are respectively a sulphur atom and $X^3$ and $X^4$ are respectively an oxygen atom, and an organic molybdenum compound (A2) wherein $R^1$ to $R^4$ are respectively 2-ethylhexyl; and $X^1$ and $X^2$ are respectively a sulphur atom and $X^3$ and $X^4$ are respectively an oxygen atom are preferred, and the organic molybdenum compound (A1) is more preferred.

In the lubricant additive composition of the present invention, the component (B) is an amine compound represented by general formula (2). In the general formula (2), $R^5$ and $R^6$ respectively represent an alkyl group having 1 to 18 carbon atoms or an alkenyl group having 2 to 18 carbon atoms. Examples of the alkyl group having 1 to 18 carbon atoms include alkyl groups exemplified for $R^1$ to $R^4$ in the general formula (1). Examples of the alkenyl group having 2 to 18 carbon atoms include a vinyl group, a 1-methylethenyl group, a 2-methylethenyl group, a propenyl group, a butenyl group, an isobutenyl group, a pentenyl group, a hexenyl group, a heptenyl group, an octenyl group, a decenyl group, a pentadecenyl group, an octadecenyl group and the like. $R^5$ and $R^6$ may be the same group or different groups; however, it is preferable that $R^5$ and $R^6$ are the same group because of industrial availability.

In the general formula (2), the sum of the carbon atoms of $R^5$ and $R^6$ is preferably at least 8 and more preferably at least 12 because when the amine compound has an extremely low boiling point, the amine compound in the general formula (2) is volatilized and eliminated during use.

Among the amine compounds represented by general formula (2), dibutylamine, dipropylamine, dihexylamine, diheptylamine, dioctylamine, bis(2-ethylhexyl)amine, dinonylamine, diisononylamine, didecylamine, di-branched decylamine, didodecylamine, di-branched tridecylamine, ditetradecylamine, dihexadecylamine, dioctadecylamine are preferred because of industrial availability, bis(2-ethylhexyl)amine, dinonylamine, diisononylamine, didecylamine, di-branched decylamine, didodecylamine, di-branched tridecylamine are more preferred because of an increased effect of friction reduction, and bis(2-ethylhexyl)amine and di-branched tridecylamine are still more preferred.

In the present invention, the content of the component (B) is 1 to 20 parts by mass relative to 100 parts by mass of molybdenum atoms derived from the component (A). When the content of the component (B) is less than 1 part by mass, the effect of lubricity may not be sufficient, and when the content is more than 20 parts by mass, corrosion of copper or copper alloys may occur. The component (B) is preferably 2.9 to 18.6 parts by mass, more preferably 5 to 18 parts by mass and still more preferably 10 to 17 parts by mass relative to 100 parts by mass of molybdenum atoms derived from the component (A).

The lubricant additive composition of the present invention may consist of the component (A) and the component (B). However, in view of handling and convenience upon use of the additive composition of the present invention, the composition may be dissolved in a base oil or may be in a package combined with other lubricating oil additives. When the lubricant additive composition of the present invention contains other components, the content of the component (A) is preferably at least 1% by mass and more preferably at least 20% by mass relative to the whole amount of the lubricant additive composition.

The lubricant additive composition of the present invention is added to a base oil or a base oil and a thickener to be used as, respectively, a lubricating oil composition or a grease composition. In the present invention, the lubricating oil composition and the grease composition are collectively referred to as a lubricating composition. Examples of the base oil include mineral oils such as paraffin mineral oils, naphthene mineral oils and purified mineral oils obtained by subjecting the above to hydrogenation refining, solvent deasphalting, solvent extraction, solvent dewaxing, hydrogenation dewaxing, contact dewaxing, hydrogenolysis, alkali distilling, sulphuric acid cleaning or white clay treatment; hydrocarbon synthetic oils such as poly-α-olefins, ethylene-α-olefin copolymers, polybutenes, GTL (Gas to liquids) base oils, alkylbenzenes and alkylnaphthalenes; ether synthetic oils such as polyphenyl ethers, alkyl-substituted diphenyl ethers and polyalkylene glycols; ester synthetic oils such as polyol esters, dibasic acid esters, hindered esters and monoesters; phosphate ester synthetic oils, polysiloxane synthetic oils, and fluorinated hydrocarbon synthetic oils. The base oils may be used alone or as a mixture of two or more. The base oil for which the lubricant additive composition of the present invention is used is preferably a mineral oil or a hydrocarbon synthetic oil and more preferably a paraffin purified mineral oil, a poly-α-olefin or a GTL base oil because the effect of lubricity improvement by the component (A) may be easily obtained.

Examples of the thickener used with the lubricant additive composition of the present invention for a grease include soap or complex soap thickeners, organic non-soap thickeners, inorganic non-soap thickeners and the like. A grease made of a base oil and a thickener and not containing other additives may be referred to as a base grease. The consistency of the grease for which the lubricant additive composition of the present invention is used may vary according to the application of the grease and is not particularly limited. The consistency is generally about 100 to 500, and the content of the thickener is generally about 5 to 20 parts by mass relative to 100 parts by mass of the base oil.

Examples of the soap thickener includes soaps obtained by reaction of higher fatty acids such as lauric acid, myristic acid, palmitic acid, stearic acid, 12-hydroxystearic acid, arachic acid, behenic acid, zoomaric acid, oleic acid, linoleic acid, linolenic acid and ricinoleic acid and bases such as lithium, sodium, potassium, aluminium, barium and calcium, and complex soap thickeners obtained by reaction of the fatty acids and the bases above and acetic acid, benzoic acid, sebacic acid, azelaic acid, phosphoric acid, boric acid or the like. Examples of the organic non-soap thickener include terephtalate thickeners, urea thickeners, fluorine thickeners such as polytetrafluoroethylene and fluorinated ethylene-propylene copolymers and the like. Examples of inorganic non-soap thickener include montmorillonite, bentonite, silica aerogel, boron nitride and the like. Among the thickeners, urea thickeners are preferable because the effect of friction reduction by the component (B) is increased. Examples of the urea thickener include monourea compounds obtained by reaction of monoisocyanates and monoamines, diurea compounds obtained by reaction of diisocyanates and monoamines, urea urethane compounds obtained by reaction of diisocyanates, monoamines and monools, tetraurea compounds obtained by reaction of diisocyanates, diamines and monoisocyanates and the like.

In the lubricating composition of the present invention, an extremely low content of the component (A) of the present invention may cause an insufficient effect of friction reduction, and an extremely high amount of addition may cause sludge and corrosion. When the lubricating composition of the present invention is a lubricating oil composition, the component (A) in terms of the amount of molybdenum atoms is preferably 50 to 2000 ppm by mass, more preferably 70 to 1500 ppm by mass and still more preferably 400 to 1200 ppm by mass relative to the whole amount of the lubricating composition. When the lubricating composition of the present invention is a grease composition, the amount of the component (A) added in terms of the amount of molybdenum atoms is preferably 100 ppm by mass to 5% by mass, more preferably 150 ppm by mass to 3% by mass and still more preferably 200 ppm by mass to 2% by mass relative to the grease and the like.

Generally, the lubricating composition may contain, if necessary, a metal-based cleaner, an ashless dispersant, an antioxidant, an oiliness agent, an anti-wear agent, an extreme pressure agent, a rust preventing agent, a metal deactivator, a viscosity index improver, a pour point depressant, a solid lubricant and the like.

[Metal-Based Cleaner]

Examples of the metal-based cleaner include alkaline earth metal sulphonates, alkaline earth metal phenates, alkaline earth metal phosphonates, alkaline earth metal salicylates, alkaline earth metal naphthenates and the like, and examples of the alkaline earth metal include magnesium, calcium, barium and the like. The lubricating composition of the present invention preferably contains, as a component (C), an alkaline earth metal salicylate because of an increased effect of friction reduction by the component (A) and calcium salicylate is preferred among others.

Metal-based cleaners having a total base number (TBN) according to ASTM D2896 of 20 to 600 mgKOH/g are known. When the TBN is extremely low, a high amount of metal-based cleaner must be added, and when the TBN is extremely high, the lubricity of the component (A) may be adversely affected. Metal-based cleaners diluted with light lubricant base oil or the like are generally marketed and are available. The TBN of the metal-based cleaner as used in the present invention is a TBN of pure component without a diluent such as light lubricant base oil. The component (C) has a TBN of preferably 50 to 500 mgKOH/g and more preferably 100 to 450 mgKOH/g. Generally, a metal-based cleaner has an increased TBN by including a carbonate salt of an alkaline earth metal, and the component (C) of the present invention may contain a borate salt instead of some of the carbonate salt.

When the content of the component (C) is extremely low, an effect by the component (C) may not be sufficiently obtained, and when the content is extremely high, the effect of friction reduction by the component (A) may be decreased. Therefore, the content of the component (C) in the lubricating composition of the present invention is preferably 0.1% to 10% by mass, more preferably 0.5% to 8% by mass and still more preferably 1% to 5% by mass relative to the whole amount of the lubricating composition.

[Ashless Dispersant]

Examples of the ashless dispersant include succinimide dispersants obtained by condensation reaction of alkenyl succinic anhydrides and polyamine compounds, succinate ester dispersants obtained by condensation reaction of alkenyl succinic anhydrides and polyol compounds, succinate ester amide dispersants obtained by condensation reaction of alkenyl succinic anhydrides and alkanolamines, Mannich base dispersants obtained by condensation of alkylphenols and polyamines with formaldehyde, and the like. The lubricating composition of the present invention preferably contains, as a component (D), a succinimide dispersant because of an increased effect of friction reduction by the component (A). Succinimide dispersants may be divided into monosuccinimide dispersants having one alkenyl succinimide group in a molecule and bis-succinimide dispersants having two alkenyl succinimide groups, and bis-succinimide dispersants are preferred because of excellent effect of lubricity improvement. Ashless dispersants include boric acid-modified ashless dispersants (compounds obtained by dehydration condensation of boric acid with ashless dispersants), and succinimide dispersants containing 0.1% to 5% by mass of boric acid as boron atoms are particularly preferred because of an increased effect of friction reduction by the component (A).

When the content of the component (D) in the lubricating composition of the present invention is extremely low, an effect by the component (D) may not be sufficiently obtained, and when the content is extremely high, an effect corresponding to the added amount may not be obtained and flowability may decrease. Therefore, the content of the component (D) is preferably 0.5% to 10% by mass, more preferably 1% to 8% by mass and still more preferably 2% to 6% by mass relative to the whole amount of the lubricating composition.

[Antioxidant]

Examples of the antioxidant include aromatic amine antioxidants, phenolic antioxidants, phosphite ester antioxidants, thioether antioxidants and the like. The lubricating composition of the present invention preferably contains, as a component (E), a phenolic antioxidant because the phenolic antioxidant has a high antioxidant effect and an effect of lubricity improvement by the component (A) may continue over a long period.

Examples of the phenolic antioxidant includes phenolic antioxidants without ester group such as 2,6-di-t-butylphenol 2,6-di-t-butyl-p-cresol, 2,6-di-t-butyl-4-methylphenol, 2,6-di-t-butyl-4-ethylphenol, 2,4-dimethyl-6-t-butylphenol, 4,4'-methylenebis(2,6-di-t-butylphenol), 4,4'-bis(2,6-di-t-butylphenol), 4,4'-bis(2-methyl-6-t-butylphenol), 2,2'-methylenebis(4-methyl-6-t-butylphenol), 2,2'-methylenebis(4-ethyl-6-t-butylphenol), 4,4'-butylidenebis(3-methyl-6-t-butylphenol), 4,4'-isopropylidenebis(2,6-di-t-butylphenol), 2,2'-methylenebis(4-methyl-6-cyclohexylphenol), 2,2'-methylenebis(4-methyl-6-nonylphenol), 2,2'-isobutylidenebis(4,6-dimethylphenol), 2,6-bis(2'-hydroxy-3'-t-butyl-5'-methylbenzyl)-4-methylphenol, 3-t-butyl-4-hydroxyanisole, 2-t-butyl-4-hydroxyanisole, 4,4'-thiobis(3-methyl-6-t-butylphenol), 4,4'-thiobis(2-methyl-6-t-butylphenol), 2,2'-thiobis(4-methyl-6-t-butylphenol), 2,6-di-t-butyl-α-dimethylamino-p-cresol, 2,6-di-t-butyl-4-(N,N'-dimethylaminomethylphenol), bis(3,5-di-t-butyl-4-hydroxybenzyl)sulphide, tris{(3,5-di-t-butyl-4-hydroxyphenyl)propionyl-oxyethyl}isocyanurate, tris(3,5-di-t-butyl-4-hydroxyphenyl)isocyanurate, 1,3,5-tris(3,5-di-t-butyl-4-hydroxybenzyl)isocyanurate, bis{2-methyl-4-(3-n-alkylthiopropionyloxy)-5-t-butylphenyl}sulphide, 1,3,5-tris(4-t-butyl-3-hydroxy-2,6-dimethylbenzyl)isocyanurate, tetraphthaloyl-di(2,6-dimethyl-4-t-butyl-3-hydroxybenzylsulphide), 6-(4-hydroxy-3,5-di-t-butylanilino)-2,4-bis(octylthio)-1,3,5-triazine, N,N'-hexamethylenebis(3,5-di-t-butyl-4-hydroxy-hydrocinnamide), 3,5-di-t-butyl-4-hydroxy-benzyl-phosphate diester, bis(3-methyl-4-hydroxy-5-t-butylbenzyl)sulphide, 3,9-bis[1,1-dimethyl-2-{β-(3-t-butyl-4-hydroxy-5-methylphenyl)propionyloxy}ethyl]-2,4,8,10-tetraoxaspiro[5,5]undecane, 1,1,3-tris(2-methyl-4-hydroxy-5-t-butylphenyl)butane and 1,3,5-trimethyl-2,4,6-tris(3,5-di-t-butyl-4-hydroxybenzyl)benzene; and phenolic antioxidants with ester group such as alkyl 3-(4-hydroxy-3,5-di-t-butylphenyl)propionate, alkyl 3-(4-hydroxy-3-methyl-5-di-t-butylphenyl)propionate, tetrakis{3-(4-hydroxy-3,5-di-t-butylphenyl)propionyloxymethyl}methane, 3-(4-hydroxy-3,5-di-t-butylphenyl)propionate glycerol monoester, ester of 3-(4-hydroxy-3,5-di-t-butylphenyl)propionic acid and glycerol monooleyl ether, 3-(4-hydroxy-3,5-di-t-butylphenyl)propionate butylene glycol diester, 3-(4-hydroxy-3,5-di-t-butylphenyl)propionate thiodiglycol diester, 2,2-thio-{diethyl-bis-3-(3,5-di-t-butyl-4-hydroxyphenyl)}propionate, bis{3,3'-bis-(4'-hydroxy-3'-t-butylphenyl)butyric acid} glycol ester.

The component (E) is preferably a phenolic antioxidant with ester group because of an effect of lubricity improvement and a phenolic antioxidant with one ester group is more preferred because of high solubility in base oils, alkyl 3-(4-hydroxy-3,5-di-t-butylphenyl)propionate and alkyl 3-(4-hydroxy-3-methyl-5-di-t-butylphenyl)propionate are still more preferred and alkyl 3-(4-hydroxy-3,5-di-t-butylphenyl)propionate is the most preferred. The alkyl group in the alkyl moiety in alkyl 3-(4-hydroxy-3,5-di-t-butylphenyl)propionate and alkyl 3-(4-hydroxy-3-methyl-5-di-t-butylphenyl)propionate is preferably an alkyl group having 4 to 22 carbon atoms because of high solubility in base oils, an alkyl group having 6 to 18 carbon atoms is more preferred, an alkyl group having 7 to 12 carbon atoms is still more preferred, an alkyl group having 7 to 9 carbon atoms is yet more preferred and a branched alkyl group having 7 to 9 carbon atoms is the most preferred.

When the content of the component (E) in the lubricating composition of the present invention is extremely low, an antioxidant effect is low, and when the content is extremely high, the performance improvement commensurate with the added amount may not be obtained and decomposition of the component (A) may be promoted. Therefore, the content of the component (E) is preferably 0.01% to 1% by mass, more preferably 0.15% to 0.95% by mass and the most preferably 0.2% to 0.9% by mass relative to the whole amount of the lubricating composition. Lubricating oils for internal combustion may contain, as an antioxidant, an amine antioxidant in some cases. However, the lubricating composition of the present invention preferably does not contain an amine antioxidant because the amine antioxidant may reduce the effect of friction reduction of the component (A) by the component (B), and even if contained, the content thereof is preferably 0.3% by mass or less, more preferably 0.1% by mass or less and still more preferably 0.05% by mass or less relative to the whole amount of the lubricating composition.

[Anti-Wear Agent]

Examples of the anti-wear agent include zinc dithiophosphates, alkyl phosphate esters, aryl phosphate esters, alkyl thiophosphate esters and the like. The lubricating composition of the present invention preferably contains, as a component (F), a zinc dithiophosphate represented by the following general formula (3) because of a high anti-wear effect and also an effect of lubricity improvement of the component (A):

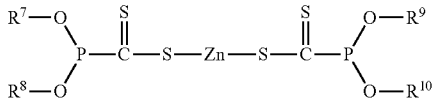

(3)

wherein $R^7$ to $R^{10}$ respectively represent an alkyl group having 3 to 14 carbon atoms.

In the general formula (3), $R^7$ to $R^{10}$ respectively represent an alkyl group having 3 to 14 carbon atoms. Examples of the alkyl group having 3 to 14 carbon atoms include linear primary alkyl groups such as a propyl group, a butyl group, a pentyl group, a hexyl group, a heptyl group, an octyl group, a nonyl group, a decyl group, a dodecyl group, a tridecyl group and a tetradecyl group; branched primary alkyl groups such as an isobutyl group, an isopentyl group, an isohexyl group, an isoheptyl group, an isooctyl group, an isononyl group, an isodecyl group, an isododecyl group, an isotridecyl group, an isotetradecyl group, a 2-methylpentyl group, a 2-ethylhexyl group, a 2-propylheptyl group, a 2-butyloctyl group, a 2-pentylnonyl group and a 3,7-dimethyloctyl group; secondary alkyl groups such as an isopropyl group, a secondary butyl group, a secondary pentyl group, a secondary hexyl group, a secondary heptyl group, a secondary octyl group, a secondary nonyl group, a secondary decyl group, a secondary dodecyl group, a secondary tridecyl group, a secondary tetradecyl group and a 1,3-dimethylbutyl group; tertiary alkyl groups such as a t-butyl group and a t-pentyl group. $R^7$ to $R^{10}$ are respectively preferably a secondary alkyl group having 4 to 14 carbon atoms, more preferably a secondary alkyl group having 4 to 10 carbon atoms and still more preferably a secondary alkyl group having 4 to 8 carbon atoms because of lubricity improvement of the component (A). Specifically, a 1-methylpropyl group and a 1,3-dimethylpropyl group are preferred. $R^7$ to $R^{10}$ may be the same group or a combination of different groups.

When the content of the component (F) is extremely low, an effect of improvement of an antioxidation effect may not be sufficient, and when the content is extremely high, the performance improvement commensurate with the added amount may not be obtained and sludge may be generated. The content of the component (F) in terms of the phosphorus amount derived from the component (F) is preferably 0.001% to 3% by mass, more preferably 0.005% to 2% by mass and the most preferably 0.01% to 1% by mass relative to the whole amount of the lubricating composition.

The lubricating composition of the present invention preferably contains, as a component (G), an ashless friction regulator selected from the group consisting of polyhydric alcohol fatty acid partial esters, (poly)glycerol alkyl ethers, alkyl alkanolamines, alkenyl alkanolamines and fatty acid alkanolamides because friction may be further decreased.

Examples of the polyhydric alcohol fatty acid partial ester include glycerol monolaurate, glycerol dilaurate, glycerol monomyristate, glycerol dimyristate, glycerol monopalmitate, glycerol dipalmitate, glycerol monostearate, glycerol distearate, glycerol monooleate, glycerol dioleate, diglycerol monooleate, diglycerol dioleate, trimethylolpropane monooleate, trimethylolpropane dioleate and the like.

Examples of the (poly)glycerol alkyl ether include glyceryl lauryl ether, glyceryl myristyl ether, glyceryl palmityl ether, glyceryl stearyl ether, glyceryl oleyl ether, diglyceryl oleyl ether, triglyceryl oleyl ether and the like.

Examples of the alkyl alkanolamine include lauryl diethanolamine, myristyl diethanolamine, palmityl diethanolamine, stearyl diethanolamine, lauryl dipropanolamine, myristyl dipropanolamine, palmityl dipropanolamine, stearyl dipropanolamine and the like. Examples of the alkenyl alkanolamine include oleyl diethanolamine, oleyl dipropanolamine and the like.

Examples of the fatty acid alkanolamide include fatty acid monoethanolamides such as lauric acid monoethanolamide, myristic acid monoethanolamide, palmitic acid monoethanolamide, stearic acid monoethanolamide and oleic acid monoethanolamide; fatty acid diethanolamides such as lauric acid diethanolamide, myristic acid diethanolamide, palmitic acid diethanolamide, stearic acid diethanolamide and oleic acid diethanolamide; fatty acid N-methylethanolamides such as lauric acid N-methylethanolamide, myristic acid N-methylethanolamide, palmitic acid N-methylethanolamide, stearic acid N-methylethanolamide and oleic acid N-methylethanolamide.

The component (G) is preferably a polyhydric alcohol fatty acid partial ester and a (poly)glycerol alkyl ether, more preferably a polyhydric alcohol fatty acid partial ester, still more preferably a glycerol mono-fatty acid ester and the most preferably glycerol monooleate.

When the content of the component (G) is extremely low, sufficient effect is not obtained, and when the content is extremely high, a performance improvement commensurate with the added amount may not be obtained. The content of the component (G) is preferably 0.01% to 5% by mass, more preferably 0.05% to 2% by mass and still more preferably 0.1% to 1% by mass relative to the whole amount of the lubricating composition.

The lubricating composition of the present invention may further contain other lubricant additives that are generally used for lubricating oil. Examples of the lubricant additives include (H1) a phosphorus-based anti-wear agent or phosphorus-based antioxidant, (H2) a sulphur-based extreme pressure agent, (H3) a sulphur-based antioxidant, (H4) a thiophosphate-based extreme pressure agent, (H5) a rust preventing agent, (H6) a viscosity index improver, (H7) a metal deactivator, (H8) a defoaming agent, (H9) a solid lubricant and the like.

Examples of (H1) the phosphorus-based anti-wear agent or phosphorus-based antioxidant include organic phosphines, organic phosphine oxides, organic phosphinites, organic phosphonites, organic phosphinates, organic phosphites, organic phosphonates, organic phosphates, organic phosphoroamidates and the like.

Examples of (H2) the sulphur-based extreme pressure agent include sulphurized oil, sulphurized mineral oil, organic mono- or poly-sulphides, sulphurized polyolefins, 1,3,4-thiadiazole derivatives, thiuram disulphides, dithiocarbamate esters and the like.

Examples of (H3) the sulphur-based antioxidant include thiodipropionate esters, thiobis(phenol) compounds, polyhydric alcohol esters of alkylthiopropionic acids, 2-mercaptobenzimidazole, dilauryl sulphide, amyl thioglycolate and the like.

Examples of (H4) the thiophosphate-based extreme pressure agent include organic trithiophosphites, organic thiophosphates and the like.

The amounts of the components (H1) to (H4) added are preferably about 0.01% to 2% by mass, respectively, relative to the lubricating composition of the present invention. When the lubricating composition of the present invention is used as an engine oil, it is preferable to use the components in such a range that the total phosphorus content in the lubricating composition does not exceed 1000 ppm by mass and the total sulphur content does not exceed 5000 ppm by mass because exhaust gas purification catalysts may be toxified.

Examples of (H5) the rust preventing agent include oxidised paraffin wax calcium salts, oxidised paraffin wax magnesium salts, alkali metal salts, alkaline earth metal salts and amine salts of tallow fatty acids, alkenyl succinic esters and alkenyl succinic half-esters (molecular weight of the alkenyl group is about 100 to 300), sorbitan monoesters, pentaerythritol monoesters, glycerol monoesters, nonylphenol ethoxylates, lanolin fatty acid esters, lanolin fatty acid calcium salts and the like. The amount of the component (H5) added is preferably about 0.1% to 15% by mass relative to the whole amount of the lubricating composition, which range allows sufficient exhibition of a rust preventing effect.

Examples of the component (H6), viscosity index improver, include poly(C1-18)alkyl methacrylates, (C1-18) alkyl acrylate/(C1-18)alkyl methacrylate copolymers, diethylaminoethyl methacrylate/(C1-18)alkyl methacrylate copolymers, ethylene/(C1-18)alkyl methacrylate copolymers, polyisobutylenes, polyalkylstyrenes, ethylene/propylene copolymers, styrene/maleic ester copolymers, styrene/maleamide copolymers, hydrogenated styrene/butadiene copolymers, hydrogenated styrene/isoprene copolymers and the like. The average molecular weight is about 10,000 to 1,500,000. The amount of the component (H6) added is preferably about 0.1% to 20% by mass relative to the whole amount of the lubricating composition.

Examples of the component (H7), metal deactivator, include N,N'-salicylidene-1,2-propanediamine, alizarin, tetraalkyl thiuram disulphides, benzotriazole, benzimidazole, 2-alkyl dithiobenzimidazoles, 2-alkyl dithiobenzothiazoles, 2-(N,N-dialkylthiocarbamoyl)benzothiazoles, 2,5-bis(alkyldithio)-1,3,4-thiadiazoles, 2,5-bis(N,N-dialkylthiocarbamoyl)-1,3,4-thiadiazoles and the like. The amount of the component (H7) added is preferably about 0.01% to 5% by mass relative to the lubricating composition.

Examples of the component (H8), defoaming agent, include polydimethylsilicone, trifluoropropylmethylsilicone, colloidal silica, polyalkyl acrylates, polyalkyl methacrylates, alcohol ethoxylates/propoxylates, fatty acid ethoxylates/propoxylates, sorbitan partial fatty acid esters and the like. The amount of the component (H8) added is preferably about 1 to 1000 ppm by mass relative to the whole amount of the lubricating composition.

Examples of the component (H9), solid lubricant, include graphite, molybdenum disulphide, polytetrafluoroethylene, fatty acid alkaline earth metal salts, mica, cadmium dichloride, cadmium diiodide, calcium fluoride, lead iodide, lead oxide, titanium carbide, titanium nitride, aluminium silicate, antimony oxide, cerium fluoride, polyethylene, diamond powder, silicon nitride, boron nitride, carbon fluoride, melamine isocyanurate and the like. The amount of the component (H9) added is preferably about 0.005% to 2% by mass relative to the whole amount of the lubricating composition.

Each of the components (H1) to (H9) added may appropriately be one or more compounds.

The lubricating composition of the present invention may be used for lubrication of various applications. For example, engine oils such as gasoline engine oil and diesel engine oil, industrial lubricating oil, turbine oil, machine oil, bearing oil, compressor oil, hydraulic oil, operating oil, internal combustion oil, refrigerant oil, gear oil, automatic transmission fluid (ATF), continuously variable transmission fluid (CVTF), transaxle fluid, metal processing oil and the like may be mentioned. Alternatively, the lubricating composition may be added and used in various greases for slide bearings, roller bearings, gear wheels, universal joints, torque limiters, automobile constant velocity joints (CVJs), ball joints, wheel bearings, constant velocity gears, transmission gears and the like.

EXAMPLES

The present invention is hereinafter more specifically described by way of the Examples. In the Examples, "%" is based on the mass unless otherwise stated.

With the following compounds and base oils, lubricating compositions of Examples 1 to 14 and Comparative Examples 1 to 6 having the compositions indicated in Tables 1 and 2 were prepared. The values of the compositions indicated in the tables are in parts by mass of compounds when the whole amount of the lubricating composition is regarded as 100 parts by mass.

(A1) Compound of general formula (1), wherein $R^1$ and $R^2$ are respectively a 2-ethylhexyl group, $R^3$ and $R^4$ are respectively a branched tridecyl group, $X^1$ and $X^2$ are respectively a sulphur atom and $X^3$ and $X^4$ are respectively an oxygen atom (Mo content: 18.1%)

(A2) Compound of general formula (1), wherein $R^1$ to $R^4$ are respectively a 2-ethylhexyl group, $X^1$ and $X^2$ are respectively a sulphur atom and $X^3$ and $X^4$ are respectively an oxygen atom (Mo content: 20.7%)

(B1) Compound of general formula (2), wherein $R^5$ and $R^6$ are respectively a 2-ethylhexyl group (B2) Compound of general formula (2), wherein $R^5$ and $R^6$ are respectively a branched tridecyl group (C1) Calcium salicylate (Ca content: 10%, TBN: 280 mgKOH/g)

(C2) Boron-modified calcium salicylate (Ca content: 10%, boron content: 0.5%, TBN: 275 mgKOH/g)

(C3) Magnesium salicylate (Mg content: 6.0%, TBN: 280 mgKOH/g)

(C'1) Calcium sulphonate (Ca content: 11.4%, TBN: 300 mgKOH/g)

(D1) Bis(polyalkenyl succinimide)

(D2) Borated alkenyl succinimide (boron content: 0.34%)

(D'1) Mannich base dispersant (E1) Phenolic antioxidant with ester group indicated below:

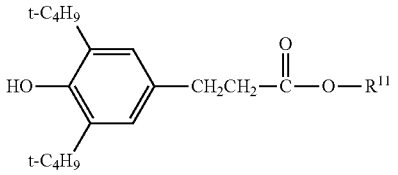

wherein $R^{11}$ is a branched alkyl group having 7 to 9 carbon atoms (F1) Compound of general formula (3), wherein $R^7$ to $R^{10}$ are respectively a 1-methylpropyl group or a 1,3-dimethylbutyl group (Base oil) Mineral oil-based oil with high VI having a kinetic viscosity at 40° C. of 18.3 $mm^2/s$ and a viscosity index of 126

The lubricating compositions of Examples 1 to 14 and Comparative Examples 1 to 6 were measured for coefficient of friction and corrosiveness to copper plates according to the methods indicated below. The results are indicated in Tables 1 and 2.

[Method for Determining Coefficient of Friction]

Tester used: SRV tester (produced by Optimol Instruments Prüftechnik GmbH, model: type 3)

Evaluation conditions:

The coefficient of friction is measured under line contact conditions of a cylinder on a plate.

Load: 200 N

Temperature: 80° C.

Measurement time: 15 minutes

Stroke: 1 mm

Upper cylinder: ϕ15×22 mm (material: SUJ-2)

Lower plate: ϕ24×6.85 mm (material: SUJ-2)

Evaluation method: The average coefficient of friction between 5 to 15 minutes is regarded as the coefficient of friction obtained by the present test. A lower coefficient of friction indicates better lubricity.

[Test Method of Corrosiveness to Copper Plates]

Test method: according to JIS K2513 (Petroleum products-Corrosiveness to copper-Copper strip test)

Test temperature: 100° C.

Test period: 3 hours

Evaluation method: The extent of corrosion is judged by comparing the discoloration of copper plates with the corrosion standard of the copper plate according to JIS K2513. The smaller number means less corrosion, and for the same numbers, corrosion is from low to high in the order of a→b→c. Systematic corrosion according to the corrosion standard of the copper plate is indicated in Tables 1 and 2.

The invention claimed is:

1. A lubricating composition comprising:

a base oil, and a lubricant additive composition comprising, as a component (A), an organic molybdenum compound of the following formula (1), as a component (B), an amine compound of the following formula (2), wherein a content of the component (B) is 2.9 to 18.6 parts by mass relative to 100 parts by mass of molybdenum atoms of the component (A), and 0.1% to 10% by mass relative to a total amount of the lubricating composition of a metal-based cleaner

TABLE 1

| | Examples | | | | | | | | | | | | | |
|---|---|---|---|---|---|---|---|---|---|---|---|---|---|---|
| | 1 | 2 | 3 | 4 | 5 | 6 | 7 | 8 | 9 | 10 | 11 | 12 | 13 | 14 |
| Al | 0.39 | 0.39 | 0.39 | 0.39 | 0.39 | — | 0.39 | 0.39 | 0.39 | 0.39 | 0.56 | 0.67 | 0.39 | 0.22 |
| A2 | — | — | — | — | — | 0.34 | — | — | — | — | — | — | — | — |
| B1 | 0.005 | 0.010 | 0.013 | 0.005 | — | 0.010 | — | 0.005 | 0.010 | 0.005 | 0.005 | 0.005 | 0.001 | 0.035 |
| B2 | — | — | — | 0.005 | 0.010 | — | 0.010 | 0.005 | — | 0.005 | 0.005 | 0.005 | 0.001 | 0.035 |
| Cl | 2.8 | 2.8 | 2.8 | 2.8 | 2.8 | 2.8 | — | — | 2.8 | 2.8 | 2.8 | 2.8 | 2.8 | 2.8 |
| C2 | — | — | — | — | — | — | 2.8 | — | — | — | — | — | — | — |
| C' l | — | — | — | — | — | — | — | 2.8 | — | — | — | — | — | — |
| D1 | 4 | 4 | 4 | 4 | 4 | 4 | 4 | 4 | — | — | 4 | 4 | 4 | 4 |
| D2 | — | — | — | — | — | — | — | — | 4 | — | — | — | — | — |
| D' l | — | — | — | — | — | — | — | — | — | 4 | — | — | — | — |
| El | 0.8 | 0.8 | 0.8 | 0.8 | 0.8 | 0.8 | 0.8 | 0.8 | 0.8 | 0.8 | 0.8 | 0.8 | 0.8 | 0.8 |
| Fl | 1 | 1 | 1 | 1 | 1 | 1 | 1 | 1 | 1 | 1 | 1 | 1 | 1 | 1 |
| Base oil | Balance | Balance | Balance | Balance | Balance | Balance | Balance | Balance | Balance | Balance | Balance | Balance | Balance | Balance |
| Mo content ppm | 700 | 700 | 700 | 700 | 700 | 700 | 700 | 700 | 700 | 700 | 1000 | 1200 | 700 | 400 |
| 100 * (amine/Mo) | 7.1 | 14.2 | 18.6 | 14.2 | 14.2 | 14.2 | 14.2 | 14.2 | 14.2 | 14.2 | 10.0 | 8.3 | 2.9 | 17.5 |
| Friction coefficient | 0.063 | 0.062 | 0.061 | 0.062 | 0.061 | 0.062 | 0.062 | 0.060 | 0.062 | 0.064 | 0.059 | 0.058 | 0.065 | 0.064 |
| Copper plate corrosiveness | 1a | 1a | 1b | 1a | 1a | 1a | 1a | 1a | 1a | la | la | la | 1a | 1a |

TABLE 2

| | Comparative Examples | | | | | |
|---|---|---|---|---|---|---|
| | 1 | 2 | 3 | 4 | 5 | 6 |
| Al | 0.39 | 0.39 | — | — | — | 0.39 |
| A2 | — | — | 0.34 | 0.34 | — | — |
| B1 | — | 0.012 | — | — | 0.010 | 0.62 |
| B2 | — | 0.012 | — | — | 0.025 | 0.62 |
| Cl | 2.8 | 2.8 | 2.8 | 2.8 | 2.8 | 2.8 |
| C2 | — | — | — | — | — | — |
| C' l | — | — | — | — | — | — |
| D1 | 4 | 4 | 4 | 4 | 4 | 4 |
| D2 | — | — | — | — | — | — |
| D' l | — | — | — | — | — | — |
| El | 0.8 | 0.8 | 0.8 | 0.8 | 0.8 | 0.8 |
| Fl | 1 | 1 | 1 | 1 | 1 | 1 |
| Base oil | Balance | Balance | Balance | Balance | Balance | Balance |
| Mo content ppm | 700 | 700 | 700 | 700 | 0 | 700 |
| 100 * (amine/Mo) | — | 34.2 | — | 35.5 | — | 1771.4 |
| Friction coefficient | 0.068 | 0.060 | 0.067 | 0.061 | 0.121 | 0.061 |
| Copper plate corrosiveness | 1a | 2d | 1a | 2d | 1a | 2e |

selected from the group consisting of an alkaline earth metal sulphonate, an alkaline earth metal phenate, an alkaline earth metal phosphonate, an alkaline earth metal salicylate, an alkaline earth metal naphthenate and a mixture thereof, wherein the alkaline earth metal is selected from the group consisting of magnesium, calcium, barium and mixtures thereof:

(1)

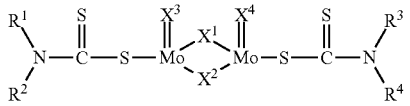

wherein $R^1$ to $R^4$ respectively represent an alkyl group having 8 to 13 carbon atoms, and $X^1$ to $X^4$ respectively represent an oxygen atom or a sulphur atom;

(2)

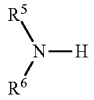

wherein $R^5$ and $R^6$ respectively represent an alkyl group selected from the group consisting of a 2-ethylhexyl group and a branched tridecyl group, wherein the lubricating composition does not comprise tetraalkyl thiuram disulphide, and wherein the component (A) in terms of the amount of molybdenum atoms is 400 to 1200 ppm by mass relative to a total amount of the lubricating composition.

2. The lubricating composition according to claim 1, comprising the alkaline earth metal salicylate as a component (C).

3. The lubricating composition according to claim 1, further comprising, as a component (D), an alkenyl succinimide dispersant.

4. The lubricating composition according to claim 1, further comprising, as a component (E), a phenolic antioxidant.

5. The lubricating composition according to claim 1, further comprising, as a component (F), a zinc dithiophosphate of the following formula (3):

(3)

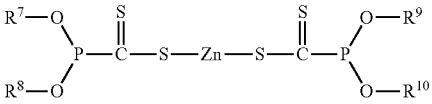

wherein $R^7$ to $R^{10}$ respectively represent an alkyl group having 3 to 14 carbon atoms.

6. The lubricating composition according to claim 1, further comprising, as a component (G), at least one ashless friction regulator selected from the group consisting of polyhydric alcohol fatty acid partial esters, (poly)glycerol alkyl ethers, alkyl alkanolamines, alkenyl alkanolamines and fatty acid alkanolamides.

7. An engine oil composition consisting of the lubricating composition according to claim 1, wherein the lubricating composition further comprises one or more components selected from the group consisting of the alkaline earth metal salicylate, an alkenyl succinimide dispersant, a phenolic antioxidant, a zinc dithiophosphate of the following formula (3), a polyhydric alcohol fatty acid partial ester, a (poly)glycerol alkyl ether, an alkyl alkanolamine, an alkenyl alkanolamine and a fatty acid alkanolamide:

(3)

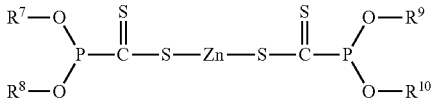

wherein $R^7$ to $R^{10}$ respectively represent an alkyl group having 3 to 14 carbon atoms.

8. A method for suppressing corrosion of a copper component of a machine and improving lubrication ability by adding, to a base oil used for a lubricating composition, a lubricating composition comprising, an organic molybdenum compound of the following formula (1), an amine compound of the following formula (2), wherein the amine compound is added at 2.9 to 18.6 parts by mass relative to 100 parts by mass of molybdenum atoms of the organic molybdenum compound, and 0.1% to 10% by mass relative to a total amount of the lubricating composition of a metal-based cleaner selected from the group consisting of an alkaline earth metal sulphonate, an alkaline earth metal phenate, an alkaline earth metal phosphonate, an alkaline earth metal salicylate, an alkaline earth metal naphthenate and a mixture thereof, wherein the alkaline earth metal is selected from the group consisting of magnesium, calcium, barium and mixtures thereof:

(1)

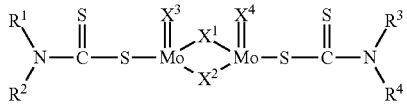

wherein $R^1$ to $R^4$ respectively represent an alkyl group having 8 to 13 carbon atoms, and $X^1$ to $X^4$ respectively represent an oxygen atom or a sulphur atom;

(2)

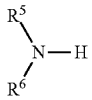

wherein $R^5$ and $R^6$ respectively represent an alkyl group selected from the group consisting of a 2-ethylhexyl group and a branched tridecyl group, wherein the lubricating composition does not comprise tetraalkyl thiuram disulphide, and wherein the organic molybdenum compound in terms of the amount of molybdenum atoms is 400 to 1200 ppm by mass relative to a total amount of the lubricating composition.

* * * * *